US006263543B1

(12) United States Patent
Daoud

(10) Patent No.: US 6,263,543 B1
(45) Date of Patent: Jul. 24, 2001

(54) SELF-LATCHING HINGE DESIGN

(75) Inventor: Bassel Hage Daoud, Morris County, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/364,292

(22) Filed: Jul. 30, 1999

(51) Int. Cl.[7] ..... E05D 11/08
(52) U.S. Cl. ..... 16/342; 16/386; 16/334
(58) Field of Search ..... 16/342, 267, 386, 16/334; 222/556, 532, 536, 517, 498; 220/840, 832

(56) References Cited

U.S. PATENT DOCUMENTS 1,166,551 * 1/1916 Sommons ..... 16/386
2,342,477 * 2/1944 Magnenat ..... 16/257
4,734,955 * 4/1988 Connor ..... 16/332
4,742,928 * 5/1988 Braun ..... 215/235
4,887,747 * 12/1989 Ostrowsky et al. ..... 16/342
5,613,275 * 3/1997 Kolberg et al. ..... 16/342

* cited by examiner

*Primary Examiner*—Chuck Y. Mah

(57) ABSTRACT

A self-latching hinge includes a connector having an outer surface with at least one irregularity. A receiver is provided that includes an inner surface with at least one irregularity. By selectively moving the connector relative to the receiver the irregularity on the outer surface of the connector is engaged with the irregularity on the inner surface of the receiver for retaining the connector and retainer in a predetermined position. The receiver is designed to be hook-shaped and constructed of a pliable material for enabling the connector to be received within a recessed portion. In a preferred embodiment, the connector is cylindrical in shape and includes a plurality of dimples disposed on the outer surface thereof. The receiver includes a cylindrical recess for receiving the connector, the cylindrical recess includes a plurality of recesses formed to selectively mate with the plurality of dimples formed on the connector for maintaining the positioning of the connector in a predetermined position relative to the receiver.

16 Claims, 4 Drawing Sheets

SELF-LATCHING HINGE DESIGN

BACKGROUND OF THE INVENTION

1. Field of the Invention

A self-latching hinge includes a connector and a receiver that are mounted relative to each other for selectively retaining the connector and the receiver in a predetermined position relative to each other.

2. Description of Background Art

Hinges are available to permit free movement between a connector and a receiver. Normally, hinges merely permit a member or cover to be opened or closed. Selectively retaining a member or cover in a predetermined partially opened position is not currently available.

SUMMARY AND OBJECTS OF THE INVENTION

It is an object of the present invention to provide a hinge that selectively permits a connector having an irregularity on an outer surface thereof to be retained in a predetermined position relative to a receiver having an irregularity on an inner surface thereof.

Another object of the present invention is to provide a hinge wherein a connector is removably mounted relative to a receiver for permitting the connector to be disengaged therefrom.

A further object of the present invention is to provide a hinge that can be mounted relative to a cover to permit the cover to be retained in a partially opened state relative to a base member.

These and other objects of the present invention are achieved by providing a self-latching hinge wherein a connector includes an outer surface with at least one irregularity. A receiver is provided that includes an inner surface with at least one irregularity. By selectively moving the connector relative to the receiver the irregularity on the outer surface of the connector is engaged with the irregularity on the inner surface of the receiver for retaining the connector and retainer in a predetermined position. The receiver is designed to be hook-shaped and constructed of a pliable material for enabling the connector to be received within a recessed portion. In a preferred embodiment, the connector is cylindrical in shape and includes a plurality of dimples disposed on the outer surface thereof. The receiver includes a cylindrical recess for receiving the connector, the cylindrical recess includes a plurality of recesses formed to selectively mate with the plurality of dimples formed on the connector for maintaining the positioning of the connector in a predetermined position relative to the receiver.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
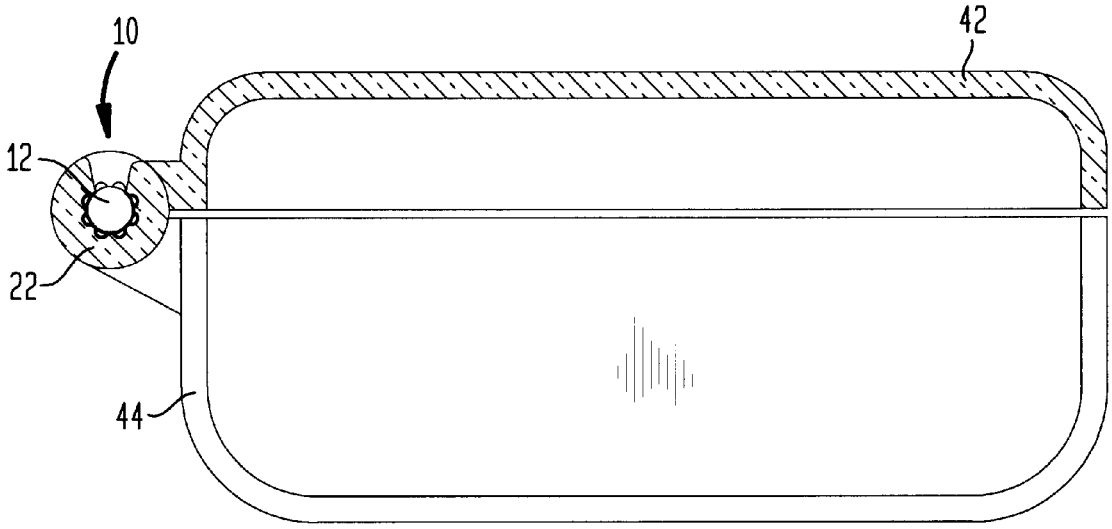
FIG. 1 is a cross-sectional view of the self-latching hinge of the present invention wherein the hinge is connected to a cover and a base member that are in a closed condition relative to each other.

Referring to FIGS. 1–4, a self-latching hinge 10 includes a connector 12 adapted to be mounted on at least one of a cover 42 or a base member 44. The connector 12 has an outer surface 14 with at least one irregularity or dimple 16 projecting from the outer surface 14.

Figure 2:
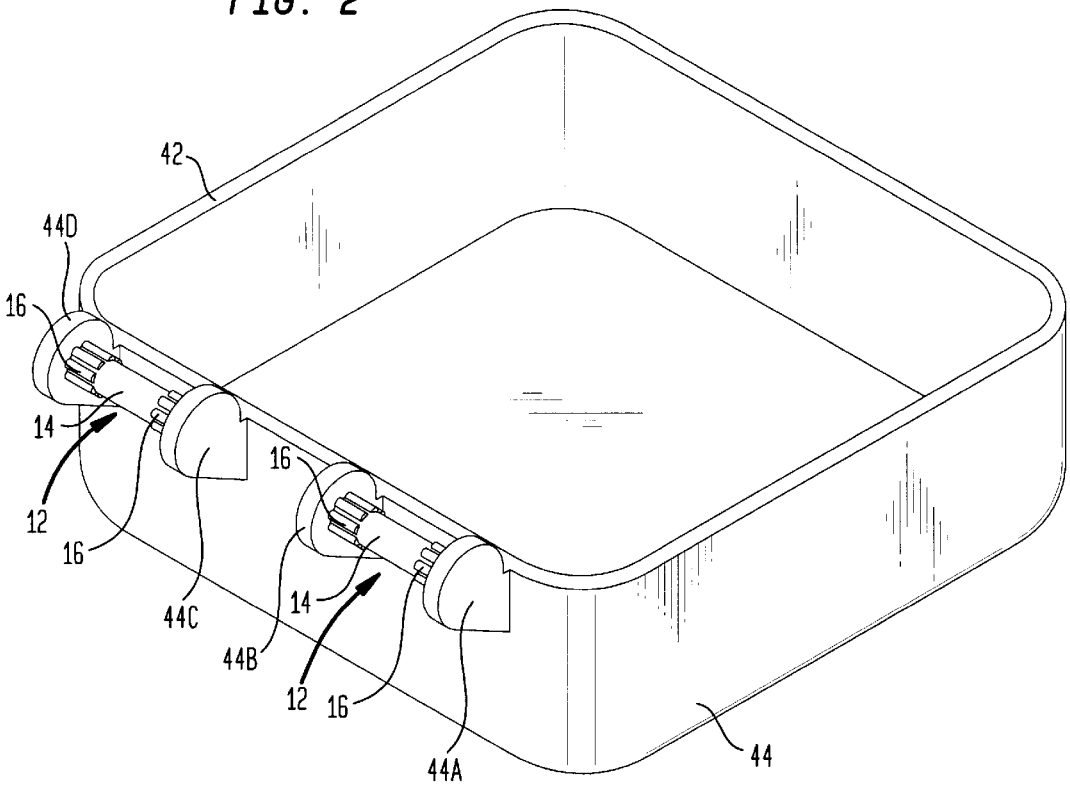
FIG. 2 is a perspective view of a connector of the present invention that is secured to a base member.

As illustrated in FIG. 2, the connector 12 is mounted on the base member 44 by brackets 44A, 44B, 44C and 44D. The irregularities or dimples 16 are formed on the end sections of the connector 12 with a smooth section formed in a central portion thereof. The connector 12 is an elongated member that is cylindrical in shape.

The self-latching hinge 10 also includes a receiver 22 adapted to be mounted on at least one of a base member 44 or a cover 42. The receiver 22 has an inner surface 24 with at least one irregularity or recess 26 formed on the inner surface 24. The inner surface 24 forms a recessed portion 28 that accommodates the connector 12 to be selectively rotated or pivoted relative thereto.

Figure 3:
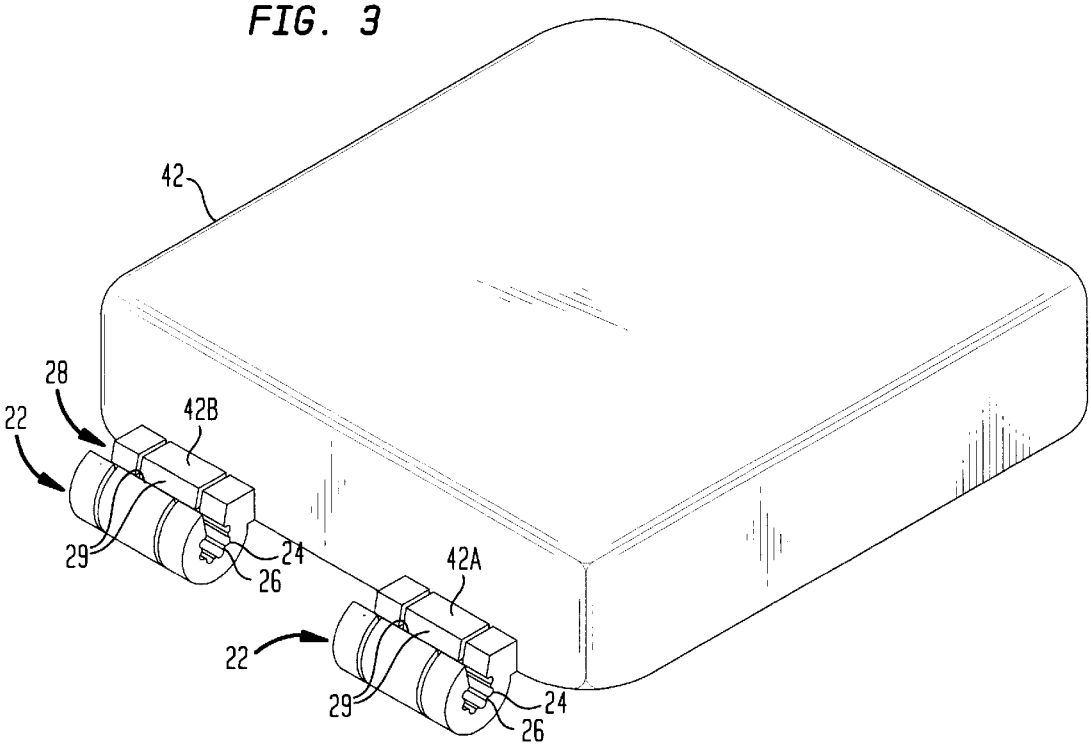
FIG. 3 is a perspective view of a receiver of the present invention that is secured to a cover member.

As illustrated in FIG. 3, the receiver 22 is mounted on the cover 42 by brackets 42A and 42B. The receiver 22 is designed to be hook-shaped and is constructed of a pliable material for enabling the connector 12 to be received within the recessed portion 28. The pliable material may be plastic or any suitable material that would resiliently deform to permit the irregularities or dimples 16 to be rotated over the irregularities or recesses 26 as the connector 12 is rotated or pivoted relative to the receiver 22. The hook-shaped form of the receiver 22 permits inclined surfaces 29 to slightly bias outwardly as the connector 12 is rotated relative to the receiver 22. In addition, the inclined surfaces 29 facilitate the positioning of the connector 12 relative to the receiver 22 as the connector 12 is inserted into the recessed portion 28. As illustrated in FIG. 3, the receiver 22 may be constructed in three sections to permit the sections to be more easily biased as a connector 12 is inserted into the recessed portion 28.

Figure 4:
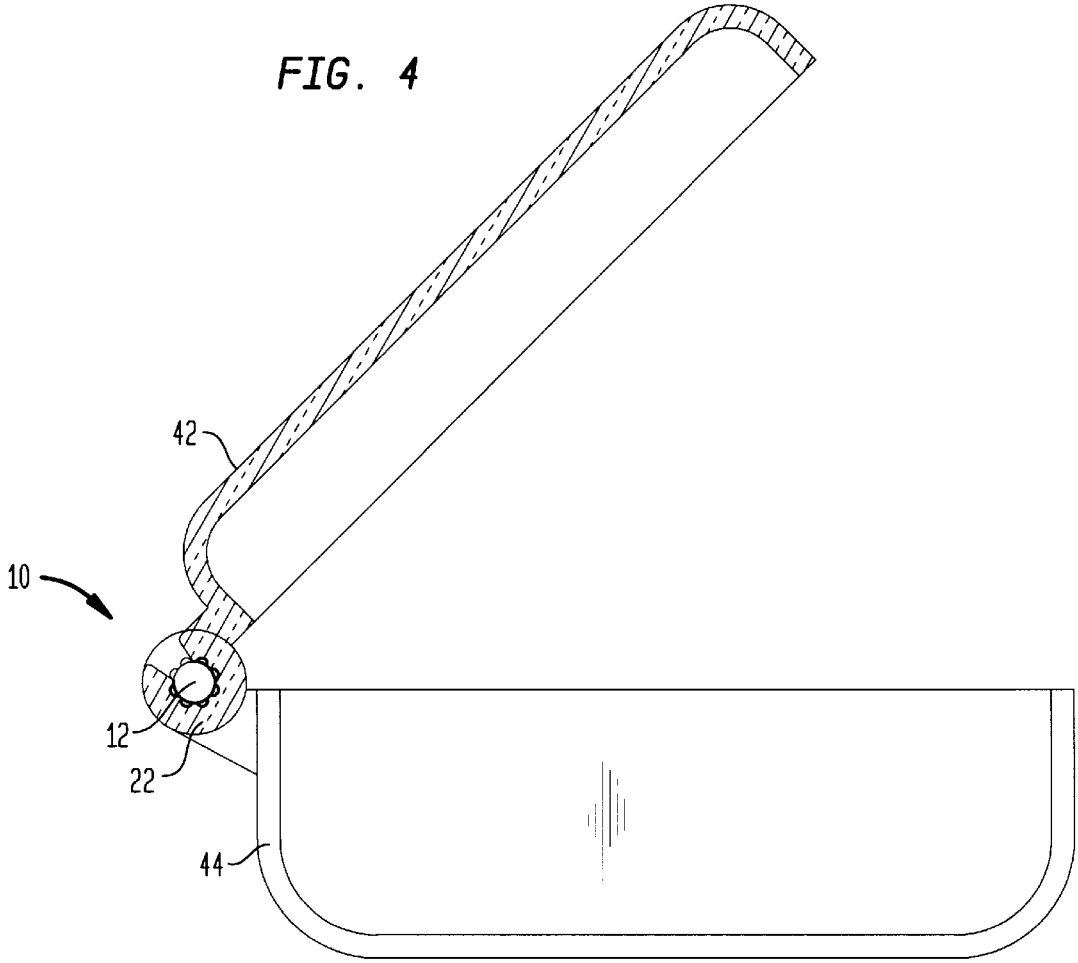
FIG. 4 is a cross-sectional view of the self-latching hinge wherein the cover and the base member are positioned in a predetermined partially open position.

As illustrated in FIG. 4, the plurality of irregularities or recesses 26 formed on an inner surface 24 of the receiver 22 are designed to selectively mate with the plurality of irregularities or dimples 16 formed on the outer surface 14 of the connector 12. As the irregularities or dimples 16 are displaced relative to the irregularities or recesses 26, the receiver 22 is engaged relative to the connector 12 to maintain the positioning of the connector 12 in a predetermined position relative to the receiver 22. Thus, the cover 42 may be held in a plurality of various opened positions relative to the base member 44. The number of various opened positions is determined by the number of irregularities or dimples 16 formed on the outer surface 14 of the connector 12 relative to the number of irregularities or recesses 26 formed on the inner surface 24 of the receiver 22.

It is to be understood that although the drawings illustrate the irregularity or dimple 16 as projecting from the outer surface 14 of the connector 12, it is within the scope of the present invention to form recesses in the outer surface 14 of the connector 12 that mate with dimples formed within the recessed portion 28 of the receiver 22.

Figure 5:
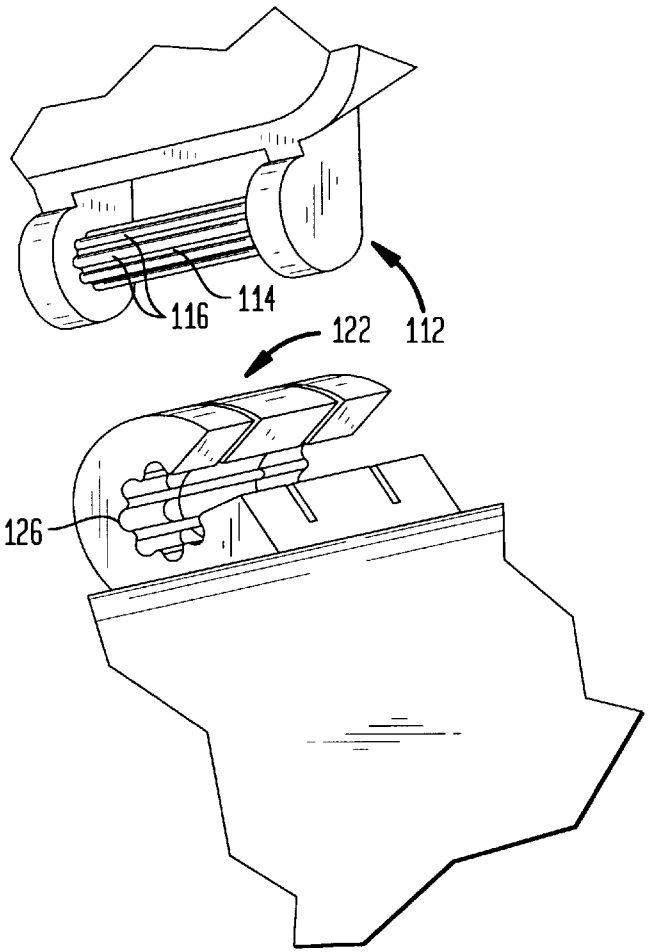
FIG. 5 is an enlarged perspective view of a hinge according to an embodiment of the present invention wherein the dimples extend continuously along the length of the connector and the receiver.

As illustrated in FIG. 5, a plurality of irregularities or recesses 126 formed on an inner surface 124 of a receiver 122 extend continuously along the length of the receiver 122 and are designed to selectively mate with a plurality of irregularities or dimples 116 formed continuously on an outer surface 114 of a connector 112. As the irregularities or dimples 116 are displaced relative to the irregularities or recesses 126, the receiver 122 is engaged relative to the connector 112 to maintain the positioning of the connector 112 in a predetermined position relative to the receiver 122. Thus, a cover may be held in a plurality of various opened positions relative to a base member. The number of various opened positions is determined by the number of irregularities or dimples 116 formed on the outer surface 114 of the connector 112 relative to the number of irregularities or recesses 126 formed on the inner surface 124 of the receiver 122.

Figure 6:
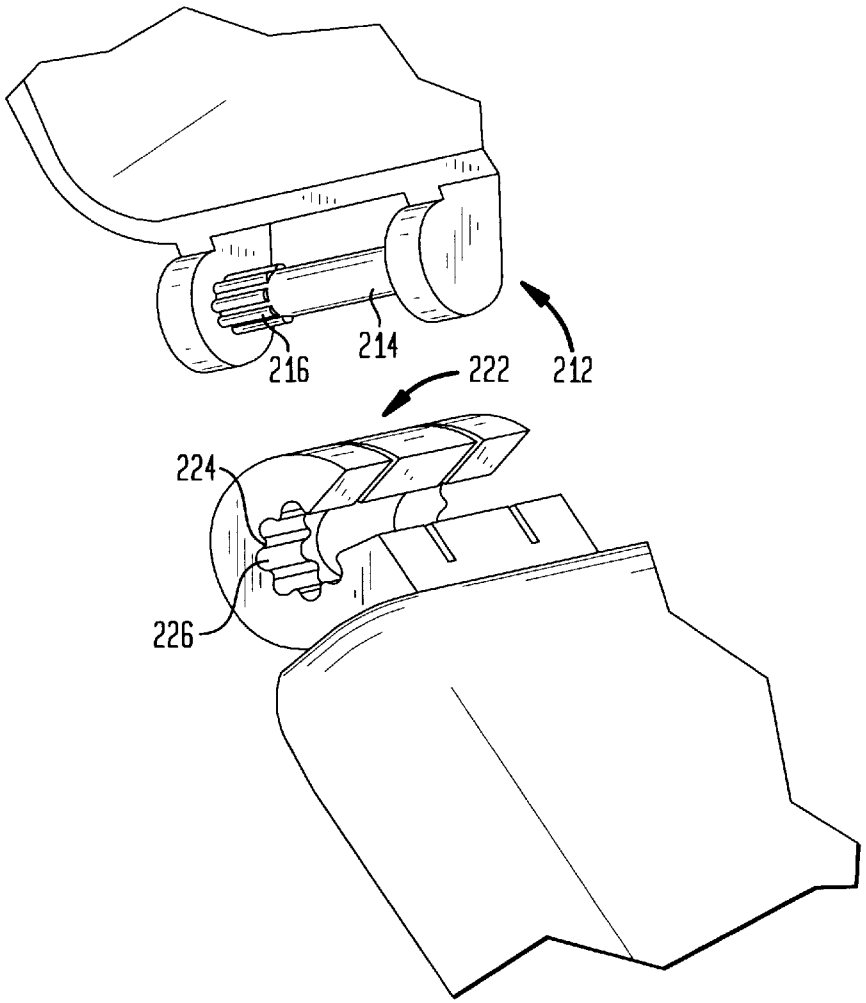
FIG. 6 is an enlarged perspective view of a hinge according to an embodiment of the present invention wherein the dimples extend along a section of the length of the connector and along a corresponding section of the receiver.

As illustrated in FIG. 6, a plurality of irregularities or recesses 226 formed on an inner surface 224 of a receiver 222 extend along a predetermined section of the length of the receiver 222 and are designed to selectively mate with a plurality of irregularities or dimples 216 formed on a predetermined section of an outer surface 214 of a connector 212. As the irregularities or dimples 216 are displaced relative to the irregularities or recesses 226, the receiver 222 is engaged relative to the connector 212 to maintain the positioning of the connector 212 in a predetermined position relative to the receiver 222. Thus, a cover may be held in a plurality of various opened positions relative to a base member. The number of various opened positions is determined by the number of irregularities or dimples 216 formed on the outer surface 214 of the connector 212 relative to the number of irregularities or recesses 226 formed on the inner surface 224 of the receiver 222.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A self-latching hinge comprising:

a connector having an outer surface with a plurality of projections extending outwardly from said outer surface or a plurality of recesses formed in said outer surface; and a receiver having an inner surface with a plurality of recesses formed in said inner surface or a plurality of projections extending outwardly from said inner surface;

said connector being adapted to be retained within said receiver and being movably mounted relative thereto;

wherein selectively moving said connector relative to said receiver engages a predetermined number of said plurality of projections or said plurality of recesses on the outer surface of said connector with a corresponding number of said plurality of recesses formed in the inner surface of said receiver or said plurality of projections extending outwardly from said inner surface of said receiver for retaining said connector and receiver in a plurality of predetermined positions relative to each other.

2. The self-latching hinge according to claim 1, wherein said connector is an elongated member, said elongated member being cylindrical in shape.

3. The self-latching hinge according to claim 1, wherein said receiver includes a recessed portion for receiving said connector relative thereto and for enabling said connector to be selectively detached from said receiver, said connector being rotatably mounted relative to said receiver to be retained in one of a plurality of predetermined positions relative to each other.

4. The self-latching hinge according to claim 3, wherein said receiver is hook-shaped and constructed of a pliable material for enabling said connector to be received within said recessed portion.

5. The self-latching hinge according to claim 1, wherein said plurality of projections extend continuously along a length of said connector and said plurality of recesses extend continuously along a length of said receiver.

6. The self-latching hinge according to claim 1, wherein said plurality of projections extend along a section of a length of said connector and said plurality of recesses extend, correspondingly, along a section of a length of said receiver.

7. The self-latching hinge according to claim 1, wherein said plurality of projections extend along at least two sections of a length of said connector and said plurality of recesses extend, correspondingly, along at least two sections of a length of said receiver.

8. The self-latching hinge according to claim 1, wherein said receiver includes at least one inclined surface for guiding said connector into said receiver.

9. A self-latching hinge for selectively retaining a cover in a predetermined position relative to a base member comprising:

a connector adapted to be secured to at least one of a cover and a base member, said connector including an outer surface with a plurality of projections extending outwardly from said outer surface or a plurality of recesses formed in said inner surface; and a receiver adapted to be secured to at least one of a base member and a cover, said receiver including an inner surface with a plurality of recesses formed in said inner surface or a plurality of projections extending outwardly from said inner surface;

said connector being adapted to be retained within said receiver and being movably mounted relative thereto;

wherein selectively moving said connector relative to said receiver engages a predetermined number of said plurality of projections or said plurality of recesses on the outer surface of said connector with a corresponding number of said plurality of recesses formed in the inner surface of said receiver or said plurality of projections extending outwardly from said inner surface of said receiver for retaining said connector and receiver in a plurality of predetermined positions relative to each other.

10. The self-latching hinge according to claim 9, wherein said connector is an elongated member, said elongated member being cylindrical in shape.

11. The self-latching hinge according to claim 9, wherein said receiver includes a recessed portion for receiving said connector relative thereto and for enabling said connector to be selectively detached from said receiver, said connector being rotatably mounted relative to said receiver to be retained in one of a plurality of predetermined positions relative to each other.

12. The self-latching hinge according to claim 11, wherein said receiver is hook-shaped and constructed of a pliable material for enabling said connector to be received within said recessed portion.

13. The self-latching hinge according to claim 9, wherein said plurality of projections extend continuously along a length of said connector and said plurality of recesses extend continuously along a length of said receiver.

14. The self-latching hinge according to claim 9, wherein said plurality of projections extend along a section of a length of said connector and said plurality of recesses extend, correspondingly, along a section of a length of said receiver.

15. The self-latching hinge according to claim 9, wherein said plurality of projections extend along at least two sections of a length of said connector and said plurality of recesses extend, correspondingly, along at least two sections of a length of said receiver.

16. The self-latching hinge according to claim 9, wherein said receiver includes at least one inclined surface for guiding said connector into said receiver.

* * * * *